US010767423B2

(12) United States Patent
Al Ameri et al.

(10) Patent No.: US 10,767,423 B2
(45) Date of Patent: Sep. 8, 2020

(54) STABILIZING SYSTEM FOR DEEP DRILLING

(71) Applicant: Abu Dhabi National Oil Company, Abu Dhabi (AE)

(72) Inventors: Fahed Salem Saleh Awadh Al Ameri, Abu Dhabi (AE); Farhaad Khaled Saeed Mohamed Al Awadhi, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 289 days.

(21) Appl. No.: 15/510,719

(22) PCT Filed: Oct. 6, 2014

(86) PCT No.: PCT/IB2014/002042
§ 371 (c)(1),
(2) Date: Mar. 13, 2017

(87) PCT Pub. No.: WO2016/055822
PCT Pub. Date: Apr. 14, 2016

(65) Prior Publication Data

US 2017/0275957 A1 Sep. 28, 2017

(51) Int. Cl.
*E21B 17/10* (2006.01)

(52) U.S. Cl.
CPC ..... *E21B 17/1078* (2013.01); *E21B 17/1014* (2013.01); *E21B 17/1021* (2013.01)

(58) Field of Classification Search
CPC ..... E21B 17/1078; E21B 17/1014; E21B 17/1021; E21B 17/10
See application file for complete search history.

(56) References Cited

U.S. PATENT DOCUMENTS 3,145,785 A 8/1964 Kellner
4,388,974 A * 6/1983 Jones, Jr. ..... E21B 17/1014 175/325.2
4,471,843 A * 9/1984 Jones, Jr. ..... E21B 7/06 175/61

(Continued)

FOREIGN PATENT DOCUMENTS

CN 103628830 A 3/2014
WO 99/28587 A1 6/1999

(Continued)

OTHER PUBLICATIONS

Examination Report of the Chinese Patent Office for corresponding Chinese Application No. 201480082480.9 dated Sep. 19, 2018.

(Continued)

*Primary Examiner* — Michael R Wills, III
(74) *Attorney, Agent, or Firm* — Renner, Otto, Boisselle & Sklar, LLP

(57) ABSTRACT

The present invention relates to a stabilizing system (100, 200, 300) adapted to be used in a drilling system, wherein the transversal diameter of the stabilizing system (100, 200, 300) increases when drilling forces are applied onto the stabilizing system (100, 200, 300). The invention further comprises a corresponding method for drilling a hole.

18 Claims, 6 Drawing Sheets

(56) References Cited

U.S. PATENT DOCUMENTS

| | | | | | |
|---|---|---|---|---|---|
| 4,572,305 | A * | 2/1986 | Swietlik | E21B 17/1078 | 175/321 |
| 4,848,490 | A * | 7/1989 | Anderson | E21B 7/06 | 175/323 |
| 4,854,403 | A * | 8/1989 | Ostertag | E21B 10/322 | 175/325.4 |
| 5,224,558 | A * | 7/1993 | Lee | E21B 7/06 | 175/325.4 |
| 5,311,953 | A * | 5/1994 | Walker | E21B 17/1014 | 175/107 |
| 5,511,627 | A * | 4/1996 | Anderson | E21B 17/06 | 175/325.2 |
| 6,041,874 | A * | 3/2000 | Lee | E21B 10/322 | 175/101 |
| 6,213,226 | B1 * | 4/2001 | Eppink | E21B 7/064 | 175/61 |
| 6,708,785 | B1 * | 3/2004 | Russell | E21B 17/1014 | 166/240 |

FOREIGN PATENT DOCUMENTS

| | | | |
|---|---|---|---|
| WO | 2013/117998 | A2 | 8/2013 |
| WO | WO 2013/117998 | A2 † | 8/2013 |

OTHER PUBLICATIONS

Examination Report of the Australian Patent Office for corresponding Australian Application No. 2014408473 dated Jul. 26, 2018.
International Search Report and Written Opinion for corresponding Patent Application No. PCT/IB2014/002042 dated Jun. 24, 2015.

* cited by examiner
† cited by third party

-- Prior Art --

-- Prior Art --

-- Prior Art --

STABILIZING SYSTEM FOR DEEP DRILLING

This application is a national phase of International Application No. PCT/162014/002042 filed Oct. 6, 2014 and published in the English language.

1. FIELD OF THE INVENTION

The present invention relates to a deep drilling system and in particular to a stabilizing system having expandable blades and is adapted to be used in the deep drilling system.

2. TECHNICAL BACKGROUND

In a deep drilling system, a drill bit is typically connected via several drill pipes, forming a drill string, to a drilling motor. Such a setup is also generally illustrated in FIG. 1. The drilling motor, provided on the earth's surface, applies drilling forces—the longitudinal and rotational forces as illustrated by arrows in FIG. 1—onto the drill string 1 such that the drill bit 3 advances further into the ground 4, thereby creating a bore hole 5. Since bore holes can reach depths of up to several kilometers, it is desired that the drill string 1 is centered in the bore hole. Particularly, the sections close to the drill bit are centered such that the drill bit 3 advances in a defined direction into the ground. For these reasons, stabilizers are typically utilized, which can be provided in form of blades 2 as illustrated in FIG. 1. These blades are fixed to the drill string 1 and extend to the walls of the bore hole 5.

During drilling operation, a water-based drilling fluid is commonly pumped downwards through the drill pipes to the drill bit, such that it flows back in the space provided between the drill string 1 and the walls of the bore hole. Thereby the drill bit is cooled, and the cuttings are transported to the surface.

When advancing through certain materials, e.g. when advancing through shale formation, the shale reacts with the water, swells and becomes sticky. This sticky mud, or sticky cuttings, can adhere between the blades 2, forming a ball of mud or mud cake 7. This effect, exemplarily illustrated in FIG. 2, is known as "balling". Thereby a cavity 6 of the bore hole 5 can be formed wherein the diameter of the mud cake 7 can become bigger than the inner diameter of the bore hole 5.

This balling can create problems, in particular during pulling-out-of-hole (POOH) and/or running-in-hole (RIH) operations. For example, as illustrated in FIG. 3, when trying to retrieve the drill string out of the hole (POOH), problems arise: The accumulated mud cake 7 can cause a severe drag, and even jam the movement of the drill string. Accordingly, POOH operations can take much longer due to balling, or in the worst case, the drill string cannot be removed from the hole at all and has to be cut off.

Typically such balling is characterized by an increased necessary rotary torque and a reduced penetration rate during drilling. Accordingly, balling can be noticed by an operator. Several methods for unballing are known in the art. For example, when balling has been noted, the drill bit can be lifted off the bottom of the bore hole and the water flow rate can be increased for a certain amount of time. Further, by spinning the drill string as fast as possible, it can then be tried to fling off the mud cake. Alternatively, it can also be tried to shake off the mud cake by lifting and dropping the drill string rapidly. It can also be tried to pump a relatively small volume of specially prepared fluid—a so called "pill"—placed or circulated in the bore hole and subsequently wash off the ball of mud. By pumping fibers in the drilling fluid, it is intended to provide a better hole cleaning. Other techniques for preventing balling are based on providing a special coating onto the drilling equipment. However, these techniques are either expensive in cost, suited for one-time use only, or are ineffective in solving the issue.

The document EP 0 285 889 B1 discloses a deep drilling tool having displacable stabiliziers, wherein the stabilizers are displaced by means of variation of the drilling fluid pressure.

It is therefore an object of the present invention to provide a system which better deals with balling than the prior art techniques or systems such that POOH and/or RIH operations can be performed easier and faster.

These and other objects, which become apparent by reading the following description, are achieved by the present invention according to the subject matter of the independent claims.

3. SUMMARY OF THE INVENTION

According to the invention, it is provided a stabilizing system, which is adapted to be used in a deep drilling system, wherein the transversal diameter of the stabilizing system increases when drilling forces are applied onto the stabilizing system. The transversal direction of the stabilizing system is perpendicular to the overall drilling direction. Furthermore, the term "drilling forces" used herein denotes to any kind of forces being applied during drilling operation, such as torques, i.e. rotational forces, and longitudinal forces applied from the outside of the bore hole onto a drill string.

Accordingly, by using the drilling forces to change the transversal diameter of the stabilizing system, it is possible to weaken or even break away at least parts of a mud cake formed around the stabilizing system. This allows for unhindered operation of the drilling system particularly easier and faster POOH and/or RIH operations. To use the drilling forces is favorable as they are always available during drilling and since they are very high. There is neither any need to provide any additional sources of energy near the drilling bit nor it is needed to use a special hydrostatic pressure of the drilling fluid. Thus, the stabilizing system does apply high forces to the spacers to increase the transversal diameter of the stabilizing system but is very reliable compared to more complex systems of the prior art.

Preferably, the transversal diameter of the stabilizing system increases when pushing forces are applied via the drill string onto the stabilizing system during drilling. On the other hand if "pulling forces" are applied to the drill string and onto the stabilizing system to remove the drill bit, drill pipes and stabilizing system from the bore hole, the transversal diameter of the stabilizing system decreases. Thus, by taking advantage of drilling forces and pulling forces as commonly applied in the art, the transversal diameter of the stabilizing system can be altered to break off a mud cake formed thereon, in order to thereby eliminate balling and make easier and faster POOH and/or RIH operations.

In a preferred embodiment, the stabilizing system is contracted along its longitudinal axis when an external load is applied in longitudinal direction onto the stabilizing system. This external load can result from drilling forces acting in drilling direction onto the stabilizing system, but can also be due to a temporary pure longitudinal force applied onto the drilling system from outside the bore hole to merely contract the stabilizing system. When the stabilizing system is contracted, the transversal diameter of the stabilizing system increases, such that the mud cake can advantageously get loose.

In a further preferred embodiment, the stabilizing system comprises a hollow housing and at least one spacer supported in an opening in the hollow housing, such that the spacer can protrude through said opening. The spacer is further moveable relative to the housing between a retracted position and an expanded position, wherein the extent of protrusion increases when the spacer is moved from the retracted position to the expanded position. The stabilizing system further comprises a column which is arranged inside the hollow housing and is being adapted to transfer drilling forces applied onto the stabilizing system. In other words, drilling forces applied by a drilling motor are transferred to the drill bit via the stabilizing system. The column is further moveable relative to the housing between a drilling position and a pulling position. When drilling forces are applied onto the stabilizing system the column moves to the drilling position. Further, the spacer is moved to the expanded position by the column when said column is moving to the drilling position.

Accordingly, the drilling forces, i.e. longitudinal and/or rotational forces, are utilized to vary the extent of protrusion of the spacer, such that mud cakes formed on or in-between the spacers can get loose. There is no need to apply further energy, like electrical current or hydraulic pressure in order to vary the extent of protrusion of the spacer. The stabilizing system is thereby able to withstand heavy workloads as particularly the movable column is adapted to transfer the drilling forces to the drilling bit. Thus, the spacer, the housing, and the column are preferably made of hard, durable alloy.

The term "spacer" used herein is not limiting to any particular shape or structure. Accordingly, the spacer can for example be present in a cylindrical or spherical shape. Preferably, however, the spacer is designed in form of a blade or fin.

Further preferred, the stabilizing system comprises restoring means which are adapted to apply a reset force in order to urge the spacer back to the retracted position. Accordingly, when no drilling forces are applied onto the stabilizing system, or preferably when the drilling forces are reduced by a certain extent, or particularly preferred when pulling forces are applied onto the stabilizing system, the restoring means urge the spacer such that it extends less through the opening of the hollow housing. This increases the space between the stabilizing system and the walls of the bore hole, allowing for an unhindered movement of the stabilizing system there through. Further, if a mud cake or ball of mud had formed around the stabilizing system, a cavity is formed therein, allowing for the mud cake to become loose and advantageously to dissolve.

Preferably, the restoring means comprises at least one helical spring arranged perpendicular to the longitudinal direction of the hollow housing. A helical spring is a reliable and strong restoring means and thus preferred for drilling systems. Preferably, the helical spring is arranged in-between the spacer and the housing.

In a further preferred embodiment, the column comprises a thin section with a first diameter and a thick section with a second diameter, whereby the second diameter is greater than the first diameter. Further, the spacer comprises a recess which is adapted to receive the thick section of the column when said column is in the pulling position. Furthermore, the thick section is adapted to urge the spacer into the expanded position when the column is moved to the drilling position. When drilling forces are applied onto the stabilizing system and the column is moved into the drilling position, the thick section of the column vacates the recess of the spacer and thereby urges the spacer into the expanded position. Accordingly, the spacers are moved into the expanded position in a straight forward manner, requiring only a minimal mechanical effort. Further, as the thick section of the column cooperates with the interior of the spacer very high displacement loads can apply. Additionally, if the spacer is in the extended position no force is required to hold it in this position as any radial force onto the spacer is adopted by the column.

Preferably, the column comprises a Kelly section and wherein the hollow housing comprises a corresponding Kelly bushing in which the Kelly section of the column is supported such that torques are transferred between the column and the hollow housing, and wherein the Kelly section is movable relative to the Kelly bushing along the longitudinal axis of the housing. Due to the Kelly section and Kelly bushing drilling forces are transferred to the drill bit while allowing the stabilizing system to contract and extend to a certain amount in order to utilize the drilling forces.

Preferably, the spacer comprises a hole or valve extending from an interior side of the spacer to an exterior side of the spacer, in particular wherein the hole or valve extends from an edge of the recess provided on the interior side of the spacer. Accordingly, when the column is moved from the drilling position to the pulling position any mud or debris collected under the spacers is pushed through the valve in order to leave a clean and empty place. This allows for a more reliable functionality of the inventive stabilizing system. Further, the expelling of mud or debris through the spacers may release the mud cake as well.

Preferably the stabilizing system further comprises a first and a second drill pipe linkage, wherein the first drill pipe linkage is adapted to be connected to a drill bit via at least one preceding dill pipe, and wherein the second drill pipe linkage is adapted to be connected to a drilling motor via at least one succeeding drill pipe, and wherein the first and second drill pipe linkages are provided on opposing longitudinal ends of the stabilizing system. Thus, the stabilizing system can be integrated into an ordinary drill string, preferably near the drill bit. External energy sources for the stabilizing system are not required. Thus the drill string can be the same as for rigid stabilizers.

Preferably, the maximal movement of one spacer relative to the housing is in the range of 5-50 mm, preferably in the range of 10-30 mm, more preferably in the range of 10-20 mm, and most preferred in the range of 10-15 mm. These movement ranges are preferred to loosen, weaken and to remove mud cakes from the stabilizing system.

Preferably the stabilizing system further comprises at least one blade being fixed to the hollow housing such that it extends from an outer surface of said housing. In addition to movable spacers the stabilizing system can further comprise one or more non-movable blade for stabilizing the drill string.

Preferably, the stabilizing system comprises at least one set of three spacers provided equally positioned around the hollow housing, whereby each one of the spacers is supported in one opening. A particular good stabilizing support for the drill string can be achieved by using three, four or even more spacers provided equally positioned around the hollow housing at the same length of the drill string.

In other embodiments a plurality of such sets of three or more spacers are arranged at different lengths of the drill string. Thus, stabilization can be achieved at different positions of the drill string, preferably near the drill bit.

Preferably, the hollow housing has an abutting face adapted to transfer drilling forces acting in longitudinal direction onto the stabilizing system to a respective counter abutting stop provided on the column, when the column is in the drilling position. After the stabilizing system is contracted to the necessary amount for extending the stabilizers the longitudinal drilling forces are fully transmitted by the stabilizing system to the drill bit via the abutting face and abutting stop. This ensures an efficient drilling.

According to the present invention, there is further provided a drilling system which comprises a stabilizing system according to the present invention and further comprises a drill bit and drill pipes.

In addition, the present invention provides a method for drilling a hole by utilizing a drilling system which comprises a stabilizing system. Said stabilizing system comprises a hollow housing, at least one spacer being movable relative to the housing between a retracted and an expanded position, and a column arranged inside the hollow housing and being moveable relative to the housing between a drilling position and a pulling housing.

The method comprises the steps of (a) applying a positive force onto the stabilizing system in longitudinal direction, i.e. in drilling direction, causing the column to move to the drilling position and causing the overall longitudinal length of the stabilizing system to shorten such that the at least one spacer is moved to the expanded position. In other words, by performing this step the stabilizing function of the stabilizing system is activated as the spacer is moving to the expanded position.

The method further comprises a step (b) of applying a negative force on the stabilizing system, whereby the negative force is opposing the positive force, thereby causing the column to move to the pulling position and causing the overall longitudinal length of the stabilizing system to elongate such that the at least one spacer is moved to the retracted position. In other words, the stabilizing function is deactivated as the spacer is moving to the retracted position. This allows for loosen, weaken and removing of an adhering mud cake from the stabilizing system.

Hence the present invention allows for providing stabilization of the drill pipes and drill bit during drilling operation and RIH operation, and further allows for an efficient handling or losing of mud cakes formed around the stabilizing system during RIH and POOH operations.

4. DESCRIPTION OF PREFERRED EMBODIMENTS

In the following the invention is described exemplarily with reference to the enclosed figures.

Figure 12:
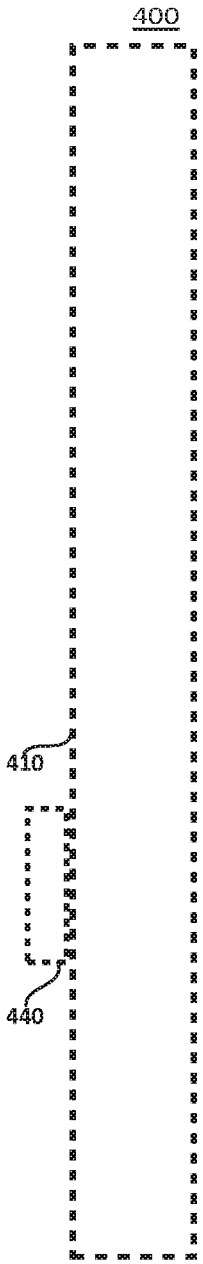

FIG. 12 schematically illustrates a stabilization system including a rigid blade or fin fixed to a hollow housing.

Figure 1:
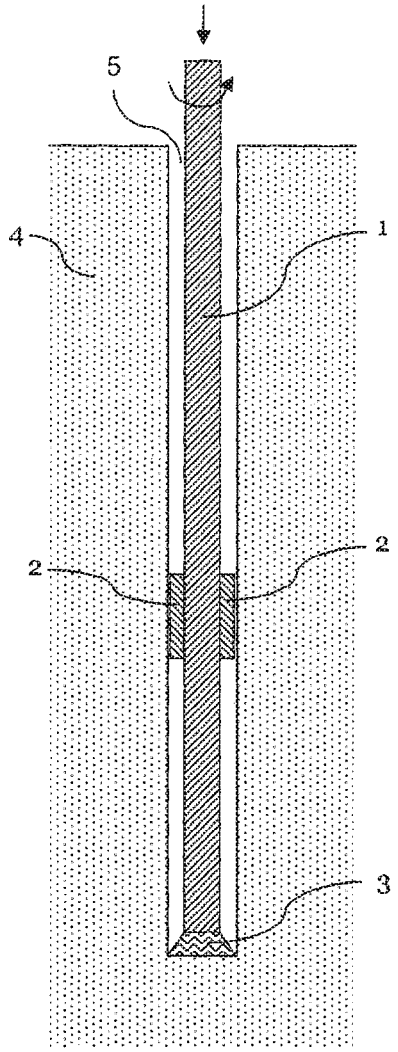
FIGS. 1-3 illustrate schematically a drilling system in different configurations.
Figure 2:
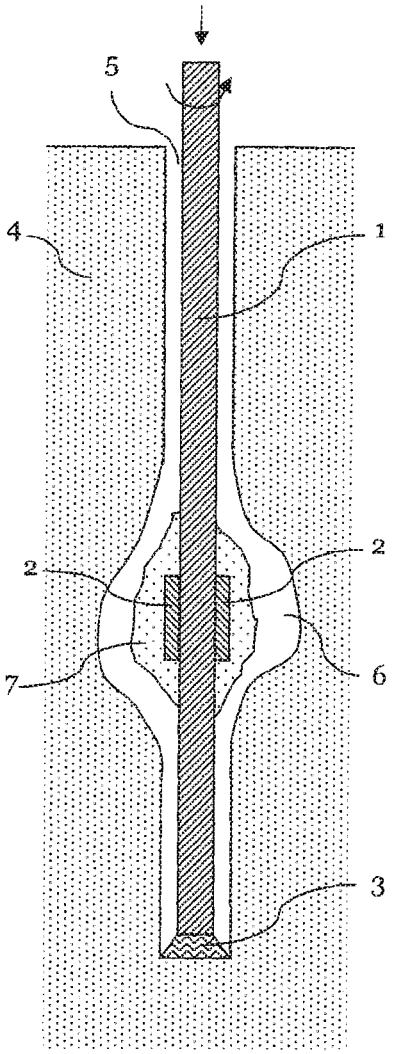
Figure 3:
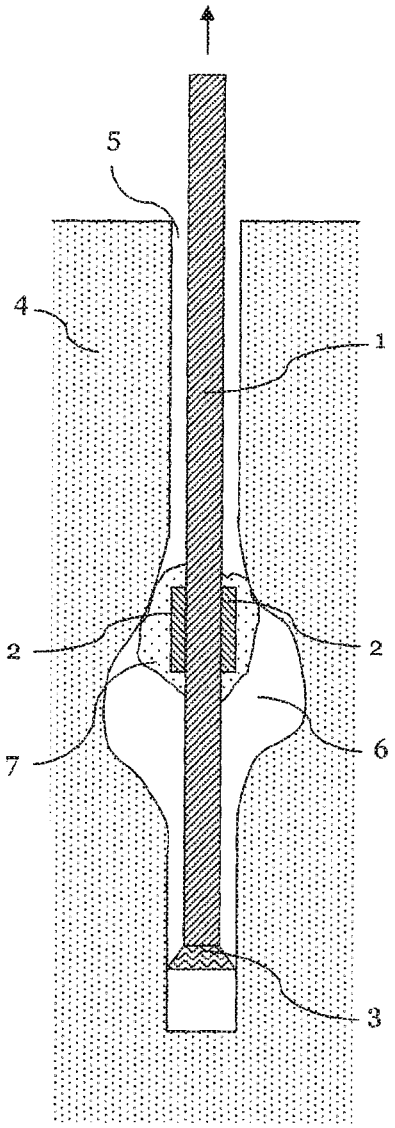
Figure 4:
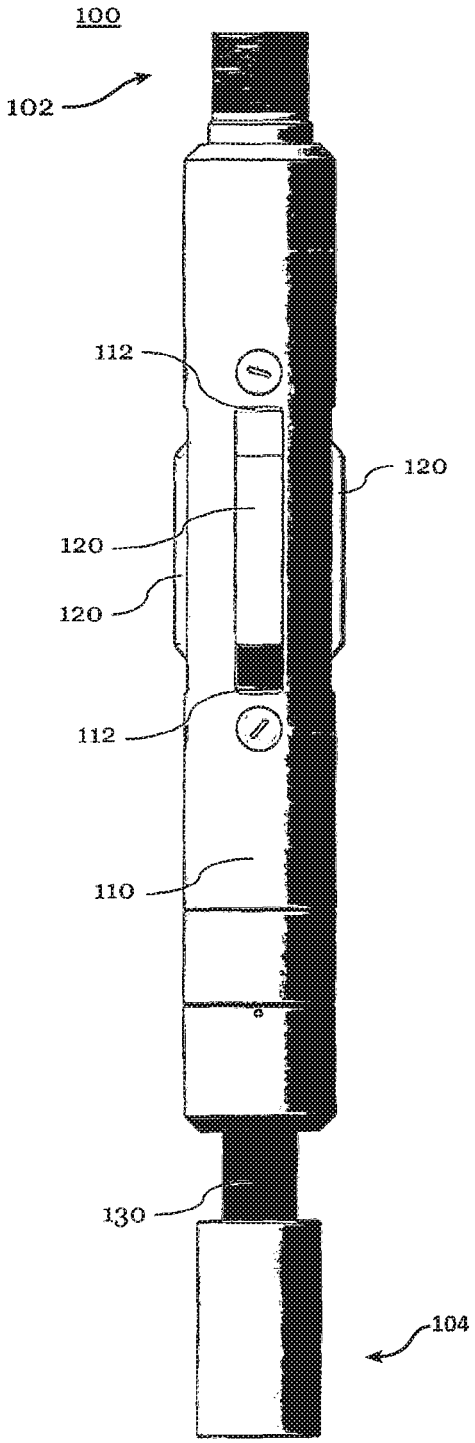
FIG. 4 illustrates a preferred embodiment of a stabilizing system according to the present invention.
Figure 5:
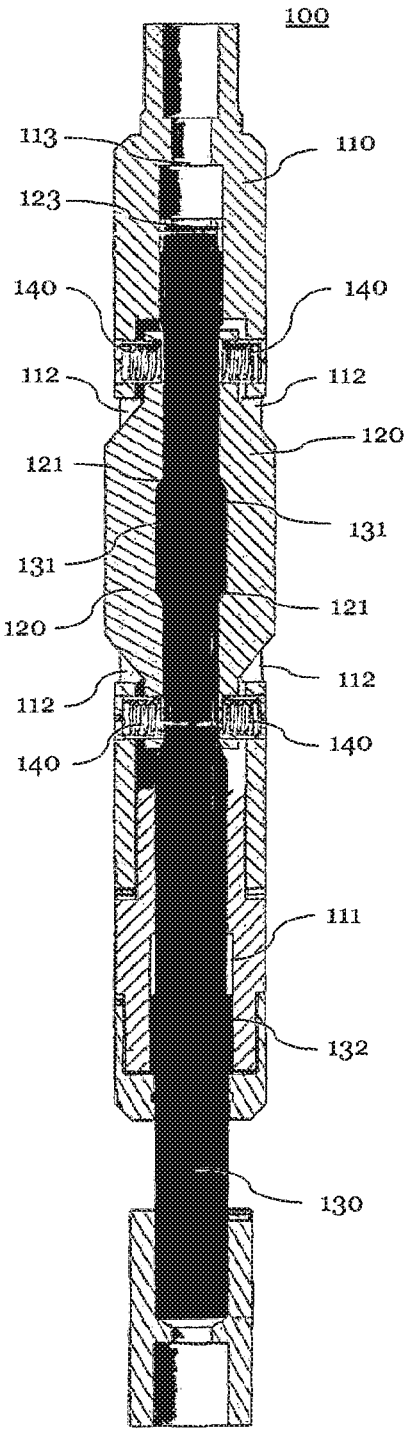
FIG. 5 is a cross-sectional view of the stabilizing system of FIG. 3.

FIG. 4 illustrates a stabilizing system 100 according to the present invention, which is adapted to be connected to drill pipes at each end thereof via respective drill pipe linkages 102 and 104. FIG. 5 shows a cross-sectional view of the arrangement of FIG. 4.

The stabilizing system 100 of FIGS. 4 and 5 comprises a hollow housing 110, in which a column 130 is linearly movably arranged. The stabilizing system 100 further comprises three spacers 120 which are positioned in respective openings 112 provided on the housing 110. As can it can be seen, the openings 112 and spacers 120 are positioned equally around the hollow housing no at the same length of the stabilizing system 100, thereby providing optimal centering of the stabilizer 100 within a bore hole. The spacers 120 are connected to the housing 110 via helical springs 140, which apply a force to urge the spacers 120 to protrude less through the openings 112 of the housing 110. The helical springs 140 are arranged in-between the spacers 120 and the housing 110. Preferably they are arranged in separately serviceable pockets such that the springs 140 and the spacers 120 can be easily unmounted and removed from the housing 110. Accordingly, if any spacer becomes worn or eroded, the operator can change one or all of the spacers instead of replacing the whole stabilizer. Further, due to the versatility of the stabilizing system, different sizes of spacers can be utilized within the same hollow housing. Thus the stabilizing system 100, 200, 300 can be used for different bore hole 5 diameters.

The column 130 further comprises a Kelly section 132 which is supported in a corresponding Kelly bushing in of the hollow housing 110. Accordingly, when applying torques onto the hollow housing 110 of the stabilizing system 100, the torques are transferred via the Kelly bushing in and Kelly section 132 to the column 130. Thus any rotational forces of the drill string are transmitted to drill bit via the stabilizing system 100, 200, 300. Further on, the Kelly section 132 of the column 130 is moveable relative to the Kelly bushing 111 along the longitudinal axis of the housing 110, i.e. along the drilling direction. Thus, the overall length of the stabilizing system 100 can be varied in order to utilize the longitudinal drilling forces for increasing the transversal diameter of the stabilizing system 100. The Kelly bushing 111 of the hollow housing 110 is arranged such that the column 130 can only be moved between two positions, which are denoted to as pulling position and drilling position herein. The column 130 presented in FIGS. 4 and 5 is in the pulling position. The Kelly bushing 111 features two end stops, preventing a full retraction of the column 130 from the housing 110. Preferably, the Kelly section 132 of the column has a length of 305 mm (1 foot).

The column 130 further comprises a thick section 131, which is arranged corresponding to respective recesses 121 of the spacers 120. The helical springs 140 urge the spacers 120 inwards the hollow housing 110 until the thick section 131 and/or the thin sections flanking the thick section 131 of the column 130 contact the spacers 120. Accordingly, the spacers 120 are in the fully retracted position in the configuration as illustrated in FIGS. 4 and 5.

Figure 6:
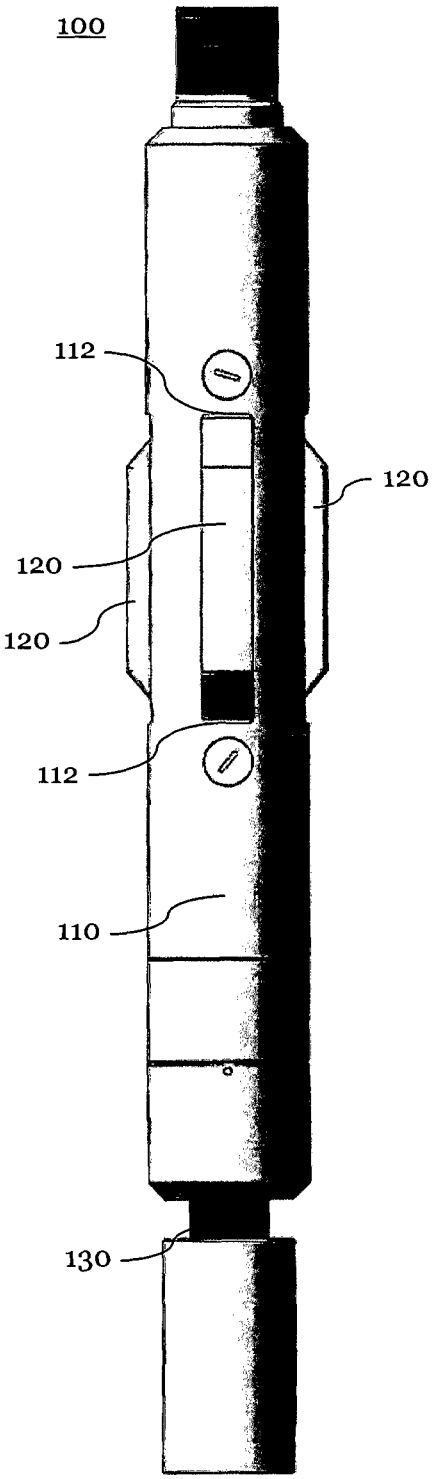
FIG. 6 illustrates the stabilizing system of FIG. 4 in another configuration.
Figure 7:
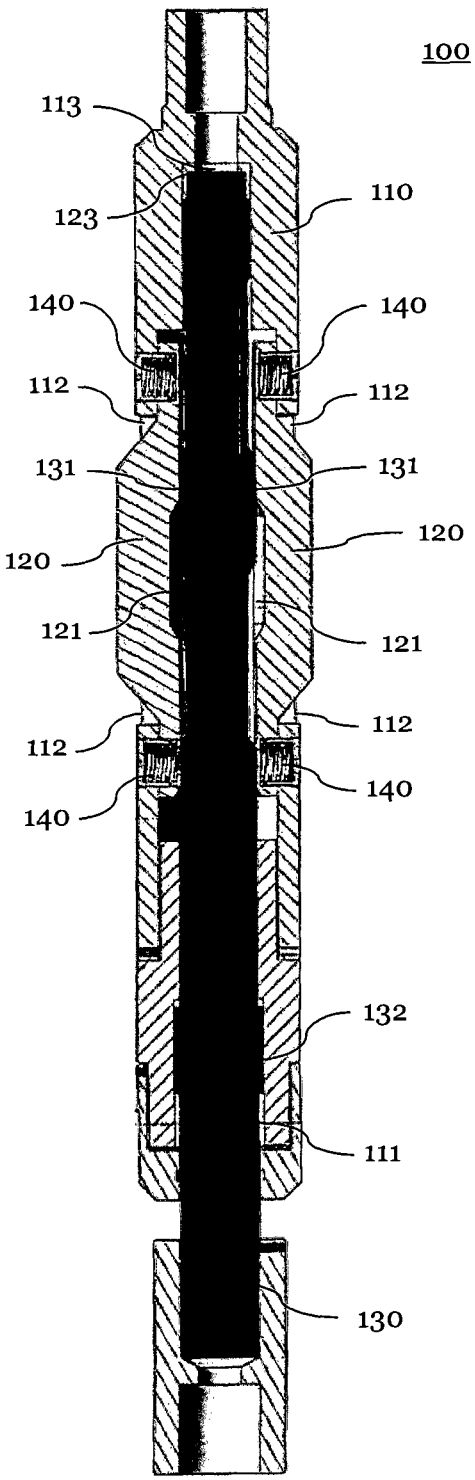
FIG. 7 is a cross-section view of the stabilizing system of FIG. 6.

FIGS. 6 and 7 correspond to the illustrations of FIGS. 4 and 5, but with the spacers 120 being in the fully expanded position. As can be seen, in particular from FIG. 7, the Kelly section 132 of the column 130 is positioned at the opposite end stop of the Kelly bushing 111 compared to the configuration illustrated in FIG. 5. Thus, the column 130 is now in the drilling position and the overall length of the stabilizing system 100 is shorter compared to a configuration with the column 130 being in the pulling position. Due to this repositioning of column 130, the thick section 131 of the column 130 now urges the spacers 120 into the expanded position, i.e. to protrude to the outside further from the openings 112 provided on the housing 110. The helical springs 140 are thus in a more compressed state.

As can further be seen, an abutting face 113 of the housing no is now in contact with a counter abutting stop 123 provided on the column 130. Thus, longitudinal drilling forces, i.e. forces acting in drilling direction, are fully transferred between the hollow housing 110 and the column 130 due to the contact between the abutting face 113 and the counter abutting stop 123. In addition, torques or torsional forces are transferred via the cooperation of Kelly section 132 and Kelly bushing 111. Accordingly, and also due to the symmetric setup of the stabilizing system 100, the drilling forces are efficiently transferred along the stabilizing system 100, while it stabilizes the drill string.

Preferably, the spacers according to the present invention have a dimension such that when in the expanded position, the outer diameter of the stabilizing system is 298 mm (11.75 inches). Further preferred, when the spacers are in the retracted position, the outer diameter of the stabilizing system is reduced by 25.4 mm (1 inch) to 273 mm (10.75 inches). Hence, the maximum retraction of each spacer is preferably 12.7 mm (0.5 inch). However, the skilled person understands that the spacers can have different dimensions, according to the used drill bit and respective diameter of the bore hole. Favorably, the maximal movement of the spacers between the expanded and retracted position is in the range of 5-50 mm, preferably in the range of 10-30 mm, more preferably in the range of 10-20 mm and most preferred in the range of 10-15 mm. Due to the inventive design, the spacers 120 can be replaced where necessary or appropriate.

The hollow housing 110 must not be a single integral element, but can be composed of several elements. Accordingly, by decomposing or dissembling the housing, it is possible to remove the column 130 from the stabilizing system 100 and to replace the spacers 120. Similarly, also the column 130 can be made from more than one piece, preferably from two pieces, for easier manufacturing and assembly. The column is hollow, such that a drilling fluid can be pumped through the column 130 and hence through the stabilizing system 100 as through the complete drilling string. Further on, the stabilizing system 100 can feature any number of spacers 120. In addition, the stabilizing system can in addition comprise also at least one rigid blade or fin which is fixed to the hollow housing 110 such that it extends from an outer surface thereof. FIG. 12, for example, schematically illustrates a stabilizing system 400 that includes the features of the stabilizing system 100 and in addition comprises at least one rigid blade or fin 440 which is fixed to a hollow housing 410.

Figure 8:
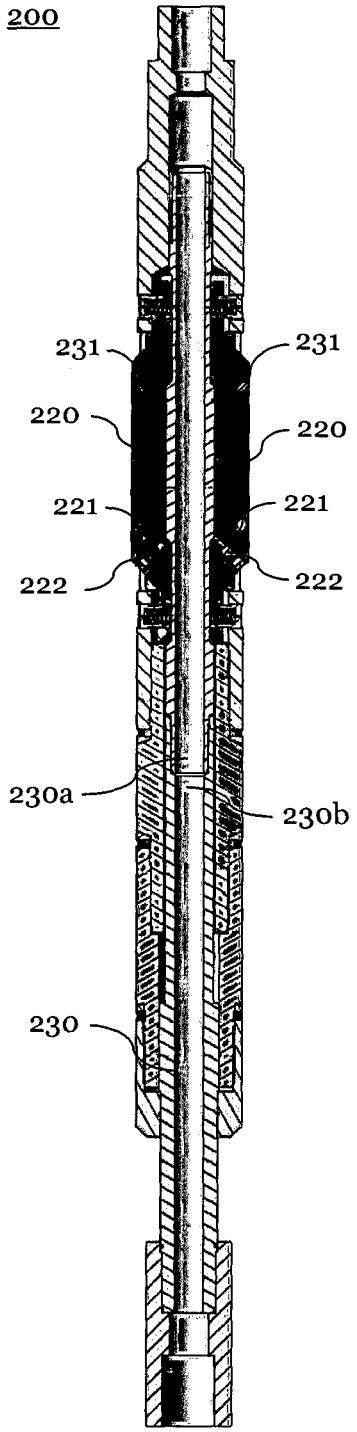
FIG. 8 illustrates a cross-section of another stabilizing system according to a preferred embodiment of the present invention.

FIG. 8 illustrates another stabilizing system 200 according to the present invention. The illustrated stabilizing system 200 is similar to that of FIGS. 4 to 7, with the additional feature that the column 230 is made of two column parts 230*a*, 230*b*, and the spacers 220 comprise a hole or valve 222 which is extending from an interior side of the spacers 220 to an exterior side thereof. As can be seen, the valves 222 extend from an edge of the recesses 221 provided on the interior side of the spacers 220. Accordingly, when the column 230 is moved from the drilling position to the pulling position, and the thick section 231 of the column 230 enters the recesses 221 of the spacers 220, any mud or debris collected under the spacers 220, i.e. in the recesses 221, is pushed through the valve 222 in order to leave a clean and empty place. Hence, the illustrated preferred embodiment allows for a more reliable functionality of the inventive stabilizing system.

Figure 9:
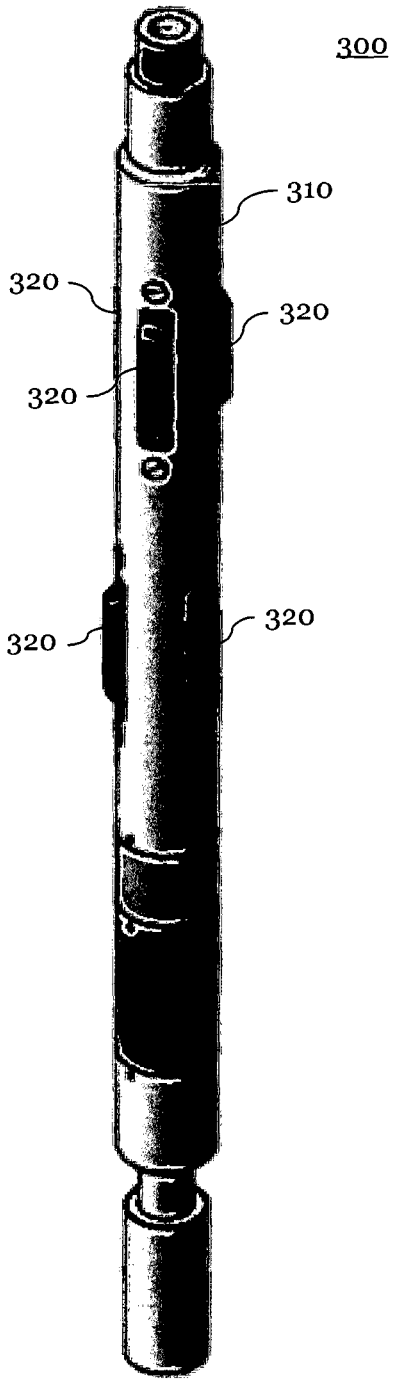
FIG. 9 illustrates another preferred embodiment of a stabilizing system according to the present invention.
Figure 10:
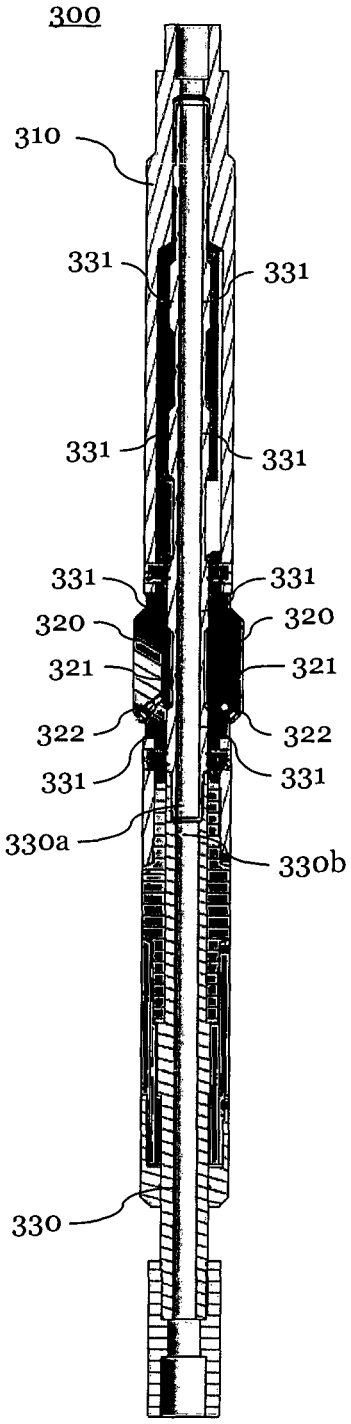
FIGS. 10 and 11 illustrate two respective cross-sections of the stabilizing system of FIG. 9.
Figure 11:
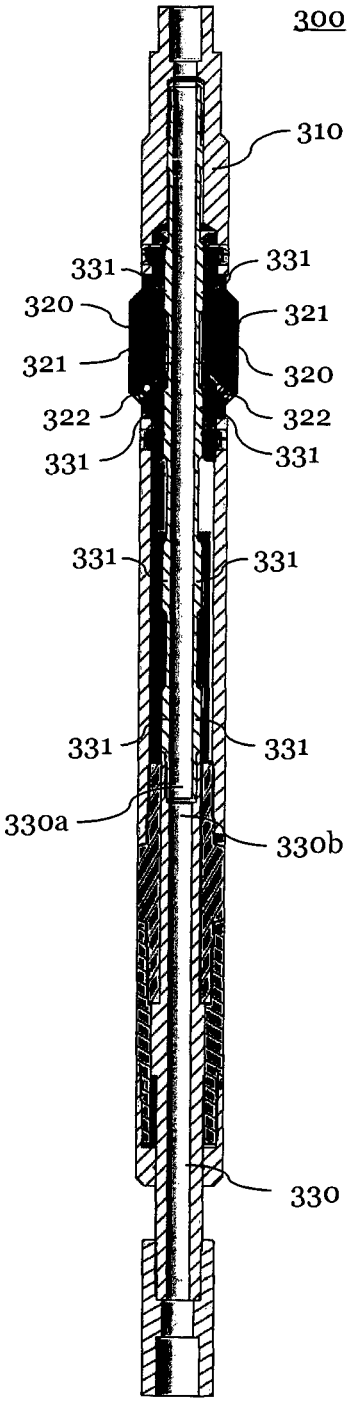

FIGS. 9, 10 and 11 illustrate another preferred embodiment, wherein the stabilizing system 300 features two sets of spacers 320 arranged at different lengths of the stabilizing system 300. Each set comprises three spacers 320 positioned equally around the stabilizing system 300. The spacers 320 of the second set are positioned such that they are aligned between the circumferential position of the spacers of the first set, but at a different length or longitudinal position along the stabilizing system 300. This configuration provides improved stabilizing function. Although balling might occur, the stabilizing system 300 featuring the inventive mechanism to alter the outer diameter thereof can efficiently loosen the mud cake or mud ball.

FIGS. 10 and 11 illustrate cross-sections of the stabilizing system 300 of FIG. 9. Similarly to the stabilizing systems 100 and 200 described above, the present stabilizing system 300 features a column 330 made of two column parts 330*a* and 330*b*, a hollow housing 310 composed of at least two parts, and several spacers 320. In order to interact with the spacers provided at two longitudinal positions along stabilizing system 300, the column 330 features several thick sections 331. In the illustrated embodiment, each spacer 320 is urged to the expanded position by two thick sections 331. This layout provides improved interaction between the column and the spacers.

When the column 330 is in the pulling position, and the spacers 320 are in the retracted position, the respective recesses 321 provided on the spacers 320 receive the respective one of the thick sections 331.

In another preferred embodiment, the spacers 320 provided at different longitudinal positions along the stabilizing system 300 are of different sizes, such that the respective outer diameter of the stabilizing system 300 with expanded spacers 320 is different at these longitudinal positions. For example, when drilling a bore hole with a diameter of 298 mm (11.75 inches), the spacers can be selected such that the outer diameter of the stabilizing system is 260 mm (10.25 inches), 267 mm (10.5 inches), or 273 mm (10.75 inches) when the spacers are in the expanded position.

The stabilizing system according to the present invention is configured such that the spacers 120, 220, 320 can easily be replaced by disassembling the housing 310, removing the column 320 therefrom and extracting the blades though the disassembled housing.

| List of reference numbers: | |
|---|---|
| 1 | drill string |
| 2 | blade |
| 3 | drill bit |
| 4 | earth |
| 5 | bore hole |
| 6 | cavity |
| 7 | mud cake |
| 100, 200, 300 | stabilizing system |
| 110, 210, 310 | hollow housing |
| 111 | Kelly bushing |
| 112 | opening |
| 113 | abutting face |
| 120, 220, 320 | spacer |

-continued

| List of reference numbers: | |
|---|---|
| 121, 221, 321 | recess |
| 222 | hole or valve |
| 123 | counter abutting face |
| 130, 230, 330 | column |
| 131, 231, 331 | thick section |
| 132 | Kelly section |
| 140 | helical spring |

The invention claimed is:

1. A stabilizing system adapted to be used in a deep drilling system, wherein the stabilizing system is configured to increase a transversal diameter of the stabilizing system when drilling forces are applied onto the stabilizing system, and wherein the stabilizing system is configured to decrease the transversal diameter when pulling forces are applied onto the stabilizing system, the stabilizing system comprising:

a hollow housing;

at least one spacer having a blade shape and supported in an opening in the housing, such that the at least one spacer can protrude through said opening and is movable relative to the housing between a retracted and an expanded position, wherein the extend of protrusion increases when the at least one spacer is moved to the expanded position;

a column arranged inside the hollow housing, being adapted to transfer drilling forces applied onto the stabilizing system, wherein the column is movable relative to the housing between a drilling position and a pulling position, a restoring means adapted to apply a reset force to urge the at least one spacer back to the retracted position; wherein the column moves to the drilling position when drilling forces are applied onto the stabilizing system, the at least one spacer is moved to the expanded position by the column moving to the drilling position, and the column comprises a thin section with a first diameter and a thick section with a second diameter, wherein the second diameter is greater than the first diameter, and the at least one spacer comprises a recess adapted to receive said thick section when the column is in the pulling position, and the thick section is adapted to urge the at least one spacer into the expanded position when the column is moved to the drilling position.

2. The stabilizing system according to claim 1, wherein the stabilizing system is contracted along a longitudinal axis thereof when an external load is applied in a longitudinal direction onto the stabilizing system, and wherein the transversal diameter of the stabilizing system increases when the stabilizing system is contracted.

3. The stabilizing system according to claim 1, wherein the column is movable along a longitudinal axis of the housing between the drilling position and the pulling position, and wherein the column moves to the drilling position when an external load is applied in longitudinal direction onto the stabilizing system.

4. The stabilizing system according to claim 1, wherein the restoring means comprises at least one helical spring arranged perpendicular to the longitudinal direction of the hollow housing, wherein the helical spring is arranged in-between the at least one spacer and the housing.

5. The stabilizing system according to claim 1, wherein the column comprises a Kelly section and wherein the hollow housing comprises a corresponding Kelly bushing in which the Kelly section of the column is supported such that torques are transferred between the column and the hollow housing, and wherein the Kelly section is movable relative to the Kelly bushing along the longitudinal axis of the housing.

6. The stabilizing system according to claim 1, wherein the at least one spacer comprises a hole or valve extending from an interior side of the spacer to an exterior side of the at least one spacer, wherein the hole or valve extends from an edge of the recess provided on the interior side of the at least one spacer.

7. The stabilizing system according to claim 1, wherein the stabilizing system further comprises a first and a second drill pipe linkage, wherein the first drill pipe linkage is adapted to be connected to a drill bit via at least one preceding drill pipe, and wherein the second drill pipe linkage is adapted to be connected to a drilling motor via at least one succeeding drill pipe, and wherein the first and second drill pipe linkages are provided on opposing longitudinal ends of the stabilizing system.

8. The stabilizing system according to claim 1, wherein the maximal movement of the at least one spacer relative to the housing is in the range of 5-50.

9. The stabilizing system according to claim 8, wherein the range is 10-30 mm.

10. The stabilizing system according to claim 9, wherein the range is 10-20 mm.

11. The stabilizing system according to claim 10, wherein the range is 10-15 mm.

12. The stabilizing system according to claim 1, further comprising at least one blade being fixed to the hollow housing such that the at least one blade extends from an outer surface of said housing.

13. The stabilizing system according to claim 1, wherein the at least one spacer comprises at least one set of three spacers provided equally positioned around the hollow housing, whereby each one of the three spacers is supported in one opening.

14. The stabilizing system according to claim 1, wherein the hollow housing has an abutting face adapted to transfer drilling forces acting in longitudinal direction onto the stabilizing system to a respective counter abutting stop provided on the column when the column is in the drilling position.

15. A drilling system comprising a stabilizing system according to claim 1 and further comprising a drill bit and drill pipes.

16. A method for drilling a hole utilizing a drilling system, comprising a stabilizing system, said stabilizing system comprising a hollow housing, at least one spacer being movable relative to the housing between a retracted and an expanded position, and a column arranged inside the hollow housing and being movable relative to the housing between a drilling position and a pulling position, the method comprising the following steps:

a. applying a positive force onto the stabilizing system in a longitudinal direction causing the column to move to the drilling position and causing the overall longitudinal length of the stabilizing system to shorten such that the at least one spacer is moved to the expanded position, the at least one spacer having a recess that is adapted to receive a section of the column when the column is in the pulling position whereby the spacer is urged into the expanded position when the column is moved to the drilling position, and b. applying a negative force on the stabilizing system in longitudinal direction causing the column to move to the pulling position and causing the overall longitudinal length of the stabilizing system to elongate such that the at least one spacer is moved to the retracted position.

17. The method according to claim 16, wherein when the negative force is applied a restoring means applies a reset force to urge the at least one spacer to the retracted position.

18. A stabilizing system adapted to be used in a deep drilling system, wherein the stabilizing system is configured to increase a transversal diameter of the stabilizing system when drilling forces are applied onto the stabilizing system, and wherein the stabilizing system is configured to decrease the transversal diameter when pulling forces are applied onto the stabilizing system, the stabilizing system comprising:

a hollow housing;

at least one spacer supported in an opening in the housing, such that the at least one spacer can protrude through said opening and is movable relative to the housing between a retracted and an expanded position, wherein the extend of protrusion increases when the at least one spacer is moved to the expanded position;

a column arranged inside the hollow housing, being adapted to transfer drilling forces applied onto the stabilizing system, wherein the column is movable relative to the housing between a drilling position and a pulling position, a restoring means adapted to apply a reset force to urge the at least one spacer back to the retracted position, thereby decreasing the transversal diameter when the column is moved from the drilling position to the pulling position, wherein the column moves to the drilling position when drilling forces are applied onto the stabilizing system, wherein the at least one spacer is moved to the expanded position by the column moving to the drilling position, thereby increasing the transversal diameter when the column is moved from the pulling position to the drilling position, and wherein the at least one spacer comprises a hole or valve extending from an interior side of the spacer to an exterior side of the at least one spacer, wherein the hole or valve extends from an edge of the recess provided on the interior side of the at least one spacer.

* * * * *